US006741827B2

(12) United States Patent
Lee

(10) Patent No.: US 6,741,827 B2
(45) Date of Patent: May 25, 2004

(54) MODIFIED TRANSFER-ROLL SYSTEM AND METHOD FOR ELECTROPHOTOGRAPHIC PRINTING OF THE LIKE

(75) Inventor: Michael H Lee, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/190,977

(22) Filed: Jul. 8, 2002

(65) Prior Publication Data

US 2004/0005175 A1 Jan. 8, 2004

(51) Int. Cl.[7] ..... G03G 15/20
(52) U.S. Cl. ..... 399/313
(58) Field of Search ..... 399/121, 297, 399/304, 310, 313, 316

(56) References Cited

U.S. PATENT DOCUMENTS 3,795,441 A * 3/1974 Hoffman et al. ..... 399/313
4,014,606 A * 3/1977 Seanor et al. ..... 399/313

* cited by examiner

*Primary Examiner*—Hoang Ngo

(57) ABSTRACT

This disclosure relates to a modified transfer-roll system and method for electrophotographic printing or the like. A photoconductor, e.g., a photoconductive roller or belt, is provided for collecting a first photostatic charge in a selected form corresponding to an image to be printed, and for retaining toner in the form of the image on a first surface of printing media. Using a first selected voltage from a first power source, a photostatic charging device, such as a charge roller and/or corona, is used to apply the first photostatic charge to the photoconductor. A laser write device activates selected portions of the charge applied to the photoconductor, such portions being in the form of the image. A development roller then transfers toner to the photoconductor, the toner photostatically adhering to the photoconductor in the form of the image. A transfer roller, in contact with the photoconductor at a selected transfer point, transfers the toner image from the photoconductor to the first surface of the printing media. At least one end of the transfer roller is sized and configured for accommodating overhanging edges of printing media as a setback from the paper edges and for clearance from toner on the photoconductor. A second power source applies a second selected voltage to the transfer roller, thereby attracting toner thereto, so as to effect transfer of the toner image from the photoconductor to the printing media first surface. Alternatively, a second surface of the printing media has a second photostatic charge to attract the toner retained by the photoconductor for transfer of the toner image.

19 Claims, 10 Drawing Sheets

MODIFIED TRANSFER-ROLL SYSTEM AND METHOD FOR ELECTROPHOTOGRAPHIC PRINTING OF THE LIKE

BACKGROUND OF THE INVENTION

The present invention relates generally to electrophotographic printing and, more particularly, to an improved transfer-roll system and method for enhanced printing, digital imaging, lithographic reproduction or the like.

During electrophotographic printing, for instance, a printed image is typically produced by transferring toner from a rotating, cylinder-like photoconductor to a sheet of paper or similar medium. This is usually accomplished by placing the paper against the photoconductor at a selected transfer point. A corona then applies a charge, such as by spraying, onto selected portions of the back side of the paper, the charge causing the paper to attract toner to the corresponding charged portions of the paper. As the photoconductor is rotated, i.e., during the toner transfer step, the paper is moved in tandem with the photoconductor. Upon contact between the photoconductor and the paper, the toner image corresponding to the charged portions is transferred from the photoconductor to the paper.

Other conventional electrophotographic printers use a semiconductive transfer-roller which is placed against the back of the paper for attracting toner to the front thereof. The roller is also soft, allowing it to press gently and uniformly against the rotating photoconductor, thereby squeezing the paper evenly against the photoconductor. Simultaneously, a voltage is applied to the roller for attracting and retaining toner on the paper. Because the soft roller, by its nature, is constructed of materials that are porous, it often captures and retains toner from the photoconductor. This usually occurs at locations where there is no paper between the roller and photoconductor.

To prevent toner and corresponding portions of the desired image from coming into contact with the transfer-roller, applications software has typically been provided to insure that the image is kept away from edge portions of the paper. In addition, transfer-rollers have been utilized that are of the same or greater width than the paper being printed upon. Since the photoconductor touches the roller only where no printing occurs, it was, therefore, believed that little or no toner could be developed on the transfer-roller.

To the contrary, however, some toner often ends up on the transfer-roller, such as on lengthwise or gap regions between consecutive sheets of paper. Toner transfer also occurs when printing on envelopes and other media considerably narrower than the transfer-roller. This toner transfer is usually due to incorrectly charged toner and/or unintended development such as during paper misfeeds. As a result, relatively small amounts of toner, e.g., between about 1% and 3% of the so-called background, end up in the gap regions and, in turn, on the transfer-roller. Eventually, a significant amount of toner is captured on the roller, typically in stripe form, causing unwanted soiling of the paper being fed and shortened roller life.

While undesirable, this occurrence was not generally considered problematic for several reasons. First, toner coverage in the unprinted or background areas is frequently quite low. Second, the transfer voltage could be turned off between sheets of paper, then on again, preventing, in theory, photoconductor to transfer-roller toner contact. Third, in applications such as printing on photographic paper where toner coverage is relatively high, such paper usually comes in a roll so that there are no gaps between sheets of paper. It is noted, in any case, that conventional printers are often readily modifiable for use of rolls rather than sheets of paper.

Although not an issue with every printing job, generally speaking, it is highly desirable to allow images to be printed to the edges of the paper. This is particularly true in photo paper printing applications which use clear toner to protect ink-jet prints. In these applications, a thick, clear toner layer about 20 microns thick, for example, is applied uniformly to the photo paper all the way to the edge thereof. The toner is then laid upon an ink-jet printed image and, subsequently, electrostatically fused to the photo paper to provide protection against moisture.

To insure coverage of the entire surface of the paper, it has been found that the photoconductor itself and, hence, the photoconductor toner layer must be generally wider than the photo paper, e.g., by several millimeters. Accordingly, where only one width of paper is used, a transfer-roller several millimeters narrower than the paper can be used without toner capture on the roller. Beyond each end of the transfer-roller, i.e., where the photoconductor (or equivalent) is wider than the paper, the toner has nowhere to go and is subsequently scraped from the photoconductor by a cleaning blade. Alternatively, where no cleaning blade is provided, toner on the photoconductor simply returns to the development region and the development roller reabsorbs the toner. Because photo paper is usually sufficiently stiff and adequately conductive to receive the desired charges from the charge roller, for optimum results, toner should be transferred uniformly to the outward most edges of the photo paper, even where there is no direct support from the transfer-roller.

Problems frequently arise, however, where multiple paper widths are utilized. Specifically, wherever the paper is narrower than the transfer-roller (and the photoconductor), some toner usually develops on the transfer-roller. This problem is magnified in that the development density present is at least twice that of solid area development densities, such as background toner levels, typically transferrable in the space between paper sheets. In some cases, up to about 2 $mg/cm^2$ may be continuously placed on the transfer-roller, resulting in relatively heavy stripes of toner on those portions of the roller adjacent to the paper edges.

Hence, when paper of greater width is subsequently printed upon, toner buildup from previous, smaller width printing jobs reduces the resiliency of the transfer-roller at the point of contact between the roller and paper. This, in turn, results in variable contact pressure, particularly in areas away from the stripes, leading to uneven transfer of toner in regions outside the striped areas. It also causes transfer of toner onto the back side of the paper, despoiling the paper and hindering fusion of the toner thereto.

A system and a method are, therefore, desired for improving the quality of printed images on printing media as the geometry of the media changes, so as to provide not only even, uniform coverage of toner and the corresponding image to be printed, but also to the physical edges of the media, simply, practically, reliably and at a relatively low cost.

SUMMARY OF THE INVENTION

Accordingly, a specific, illustrative apparatus is provided for use in a system including a photoconductor for collecting a photostatic charge in a selected form corresponding to an image to be printed, and for retaining toner in the form of the image on a first surface of printing media. The apparatus includes a transfer roller in contact with the photoconductor at a selected transfer point for transferring the toner image from the photoconductor to the first surface of the printing media. The transfer roller has at least one groove in proximity to each roller end for accommodating overhanging edges of printing media as a setback from the paper edges and for clearance from toner on the photoconductor.

Another specific, illustrative apparatus is provided for use in a system including a photoconductor for collecting a photostatic charge in a selected form corresponding to an image to be printed, and for retaining toner in the form of the image on a first surface of printing media. The apparatus includes a transfer roller in contact with the photoconductor at a selected transfer point for transferring the toner image from the photoconductor to the first surface of the printing media. The transfer roller has extendable roller ends such that, upon their extension a selected distance, at least one groove is formed in proximity to each roller end for accommodating overhanging edges of printing media as a setback from the paper edges and for clearance from toner on the photoconductor.

A further specific, illustrative apparatus is provided for use in a system including a photoconductor for collecting a photostatic charge in a selected form corresponding to an image to be printed, and for retaining toner in the form of the image on a first surface of printing media. The apparatus includes a plurality of transfer rollers arranged about a rotatable carrousel. Each roller is rotatably mounted to the carrousel such that at least one of the rollers is positionable for operative engagement with the photoconductor at a selected transfer point, such engagement effecting transfer of the toner image from the photoconductor to the first surface of the printing media. Each roller has an effective length different than that of the other rollers so as to enable overhanging edges of printing media having a selected width, such overhanging edges providing a setback from the paper edges and clearance from toner on the photoconductor.

Yet another specific illustrative apparatus is provided for use in a system including a photoconductor for collecting a photostatic charge in a selected form corresponding to an image to be printed, and for retaining toner in the form of the image on a first surface of printing media. The apparatus includes a plurality of transfer rollers arranged along a translatable carriage. Each roller is rotatably mounted to the carriage such that upon selected translation of the carriage, at least one of the rollers is positionable for operative engagement with the photoconductor at a selected transfer point. Such engagement effects transfer of the toner image from the photoconductor to the first surface of the printing media. Each roller has an effective length different than that of the other rollers so as to enable overhanging edges of printing media having a selected width. Such overhanging edges provide a setback from the paper edges and clearance from toner on the photoconductor.

Also provided is a specific, illustrative system for printing toner or the like on printing media. The system comprises a drum for retaining toner, and a transfer roller in contact with the drum at a selected transfer point for transferring a uniform layer of the toner from the drum to a first surface of the printing media. At least one end of the transfer roller is sized and configured for accommodating overhanging edges of printing media as a setback from the paper edges and for clearance from toner on the drum. In addition, a power source is provided for applying a selected voltage between the drum and the transfer roller and for attracting the toner thereto, so as to effect transfer of the uniform toner layer from the drum to the printing media first surface.

Still another specific, illustrative system is provided for printing toner or the like on printing media. The system includes a development roller for retaining toner in a form of an image desired to be printed. A transfer roller, in contact with the development roller at a selected transfer point, effects transfer of a uniform layer of the toner from the development roller to a first surface of the printing media, the toner adhering to the first surface at the selected transfer point. At least one end of the transfer roller is sized and configured for accommodating overhanging edges of printing media as a setback from the paper edges and for clearance from toner on the drum.

In addition, a specific illustrative method is provided for printing an image electrophotographically on printing media. First, a photoconductor for collecting a photostatic charge is moved in a first direction. Next, using a selected voltage from a power source, the photoconductor is charged with the photostatic charge. Selected portions of the charge applied to the photoconductor are then activated, such portions corresponding to an image to be printed on the printing media. A development roller is rotated adjacent to and in tandem with the photoconductor but in a third direction generally opposite to that of the first, and toner is transferred from the development roller to the photoconductor, the toner photostatically adhering to the photoconductor in a form corresponding to the image to be printed. Thereafter, a transfer roller is placed in contact with the photoconductor, the point of contact defining a selected point for transferring toner from the photoconductor to a first surface of the printing media. The transfer roller has at least one groove in proximity to each roller end for accommodating overhanging edges of printing media as a setback from the paper edges and for clearance from toner on the photoconductor. Next, the printing media is transported in tandem with and to a point between the photoconductor and the transfer roller. Finally, toner on the photoconductor is attracted toward the transfer roller so as to effect transfer of the toner image from the photoconductor to the printing media first surface.

Another specific illustrative method is provided for printing an image electrophotographically on printing media. Initially, a photoconductor for collecting a photostatic charge is moved in a first direction. Using a selected voltage from a power source, the photoconductor is then charged with the photostatic charge. Next, selected portions of the charge applied to the photoconductor are activated, such portions corresponding to an image to be printed on the printing media. A development roller is then rotated adjacent to and in tandem with the photoconductor but in a third direction generally opposite to that of the first. Toner is, in turn, transferred from the development roller to the photoconductor, the toner photostatically adhering to the photoconductor in a form corresponding to the image to be printed. Next, a transfer roller having extendable ends is placed in contact with the photoconductor, the point of contact defining a selected point for transferring toner from the photoconductor to the first surface of the printing media. The ends of the transfer roller are extended a selected distance such that at least one groove is formed in proximity to each roller end for accommodating overhanging edges of printing media as a setback from the paper edges and for clearance from toner on the photoconductor. The printing media is transported in tandem with and to a point between the photoconductor and the transfer roller. Finally, toner on the photoconductor is attracted toward the transfer roller so as to effect transfer of the toner image from the photoconductor to the printing media first surface.

In a further specific, illustrative method for printing an image electrophotographically on printing media, a photoconductor for collecting a photostatic charge is first moved in a first direction. Using a selected voltage from a power source, the photoconductor is then charged with the photostatic charge. Next, selected portions of the charge applied to the photoconductor are activated corresponding to an image to be printed on the printing media. A development roller is then rotated adjacent to and in tandem with the photoconductor but in a third direction generally opposite to that of the first. Toner is, in turn, transferred from the development roller to the photoconductor, the toner photostatically adhering to the photoconductor in a form corresponding to the image to be printed. Next, a carrousel having a plurality of transfer rollers arranged thereabout is rotated, each roller being rotatably mounted thereto so as to position at least one of the rollers in contact with the photoconductor upon carrousel rotation. The point of contact defines a selected point for transferring the toner image from the photoconductor to a first surface of the printing media, each roller having an effective length different than that of the other rollers so as to enable overhanging edges of printing media having a selected width. Such overhanging edges provide a setback from the paper edges and clearance from toner on the photoconductor. The printing media is transported in tandem with and to a point between the photoconductor and the transfer roller. Finally, toner on the photoconductor is attracted toward the transfer roller so as to effect transfer of the toner image from the photoconductor to the printing media first surface.

Yet another specific illustrative method relates to printing an image electrophotographically on printing media. Initially, a photoconductor for collecting a photostatic charge is moved in a first direction. Using a selected voltage from a power source, the photoconductor is then charged with the photostatic charge. Next, selected portions of the charge applied to the photoconductor, corresponding to an image to be printed on the printing media, are activated. A development roller is rotated adjacent to and in tandem with the photoconductor but in a third direction generally opposite to that of the first. Toner is, in turn, transferred from the development roller to the photoconductor, the toner photostatically adhering to the photoconductor in a form corresponding to the image to be printed. Next, a carriage with a plurality of transfer rollers rotatably mounted thereto is translated so as to position at least one of the rollers in contact with the photoconductor. The point of contact defines a selected point for transferring the toner image from the photoconductor to a first surface of the printing media. In addition, each roller has an effective length different than that of the other rollers so as to enable overhanging edges of printing media having as elected width, such overhanging edges providing a setback from the paper edges and clearance from toner on the photoconductor. The printing media is then transported in tandem with and to a point between the photoconductor and the transfer roller. Finally, toner on the photoconductor is attracted toward the transfer roller so as to effect transfer of the toner image from the photoconductor to the printing media first surface.

Still another specific, illustrative method is provided for printing toner or the like on printing media. Initially, a drum for retaining toner is rotated in a first direction. A transfer roller is then rotated in a second direction generally opposite to that of the first. The transfer roller is in contact with the drum at a selected transfer point for transferring a uniform layer of the toner from the drum to a first surface of the printing media. At least one end of the transfer roller is sized and configured for accommodating overhanging edges of printing media as a setback from the paper edges and for clearance from toner on the drum. Using a selected power source, a selected voltage is applied between the drum and the transfer roller for attracting the toner thereto so as to effect transfer of the uniform toner layer from the drum to the printing media first surface.

Yet a further specific, illustrative method is provided for printing toner or the like on printing media. First, a development roller for retaining toner in the form of an image desired to be printed is rotated in a first direction. A transfer roller is then rotated in a second direction generally opposite to that of the first. The transfer roller is in contact with the development roller at a selected transfer point for transferring a uniform layer of the toner from the development roller to a first surface of the printing media. The toner adheres to the first surface at the selected transfer point, at least one end of the transfer roller being sized and configured for accommodating overhanging edges of printing media as a setback from the paper edges and for clearance from toner on the drum.

The present invention will now be further described by reference to the following drawings which are not intended to limit the accompanying claims.

BRIEF DESCRIPTION OF THE DRAWINGS

The same numerals are used throughout the figure drawings to designate similar elements. Still other objects and advantages of the present invention will become apparent from the following description of the preferred embodiments.

DETAILED DESCRIPTION OF THE PREFERRED EMBODIMENTS

Figure 12:
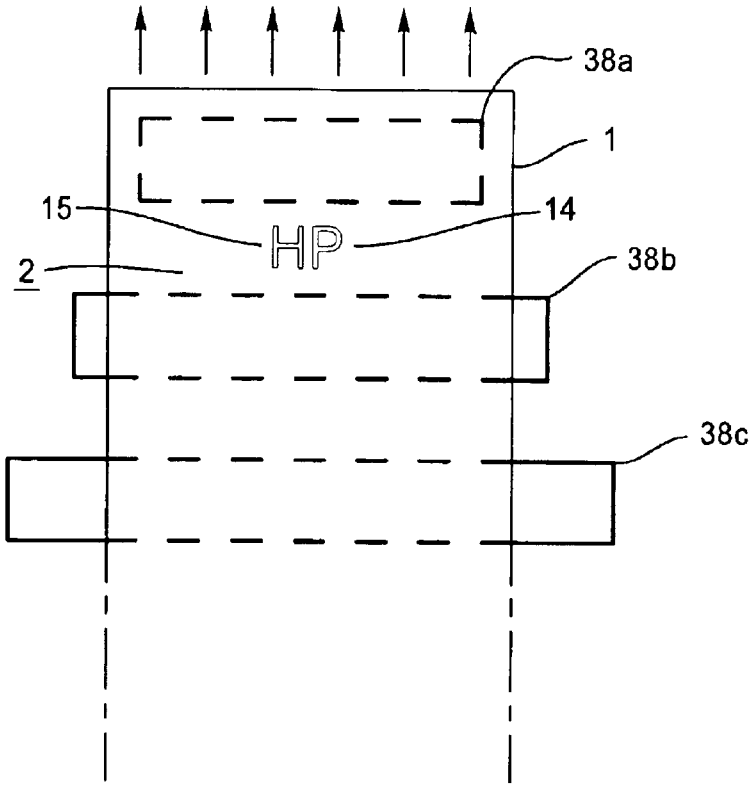
FIG. 12 is a plan view of the transfer-roller carriage set forth in FIG. 9 engaged with printing media in a first operative position.
Figure 13:
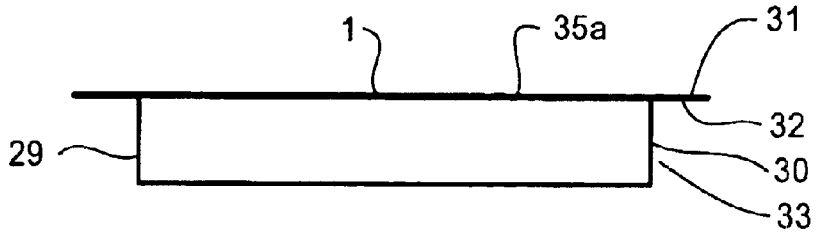
FIG. 13 is a front view of a transfer-roller of the carriage set forth in FIG. 10 engaged with printing media according to a third operative position, shown in FIG. 7.
Figure 14:
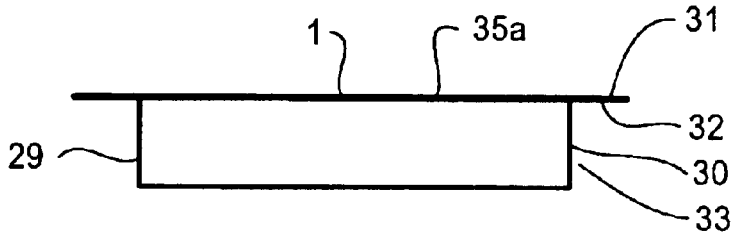
FIG. 14 is a front view of a transfer-roller of the carriage set forth in FIG. 10 engaged with printing media according to a second operative position, shown in FIG. 6.
Figure 15:
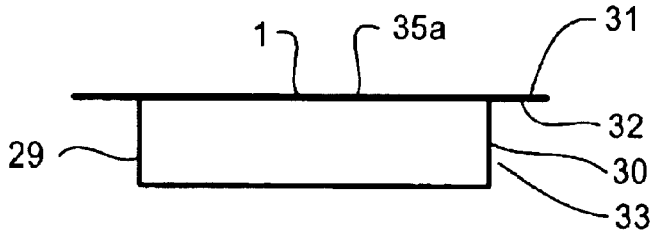
FIG. 15 is a front view of a transfer-roller of the carriage set forth in FIG. 10 engaged with printing media according to a first operative position, shown in FIG. 5.
Figure 16:
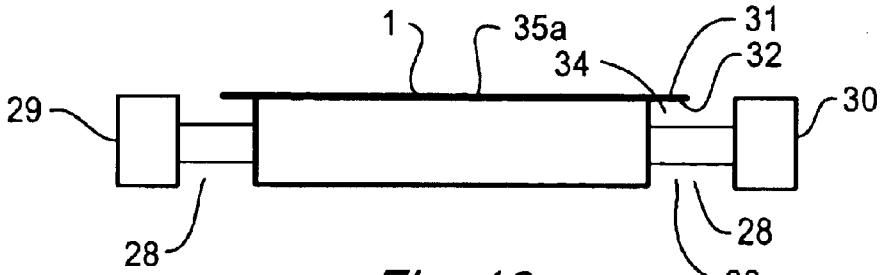
FIG. 16 is a front view of a transfer-roller having extendable ends, according to one aspect of the present invention, operatively engaged with printing media.

Referring now to the drawings and, more particularly, to FIGS. 1–18A, there is shown generally a specific, illustrative transfer-roller system 10 for printing electrophotographically, or by an analogous method, on selected printing media 1 such as paper, plastic or the like, in accordance with the present invention. In one embodiment, shown generally in FIGS. 1–9, the system comprises a series of rollers 11 operatively positioned about a photoconductor such as photoconductive roller 12 which revolves about a central axis 13. As best seen in FIG. 12, the photoconductive roller, preferably a semiconductive drum, is desirably adapted for collecting a photostatic charge in a selected form 14 corresponding to an image 15 to be printed, and for retaining toner in the form of the image on a first surface 2 of the printing media.

Figure 1:
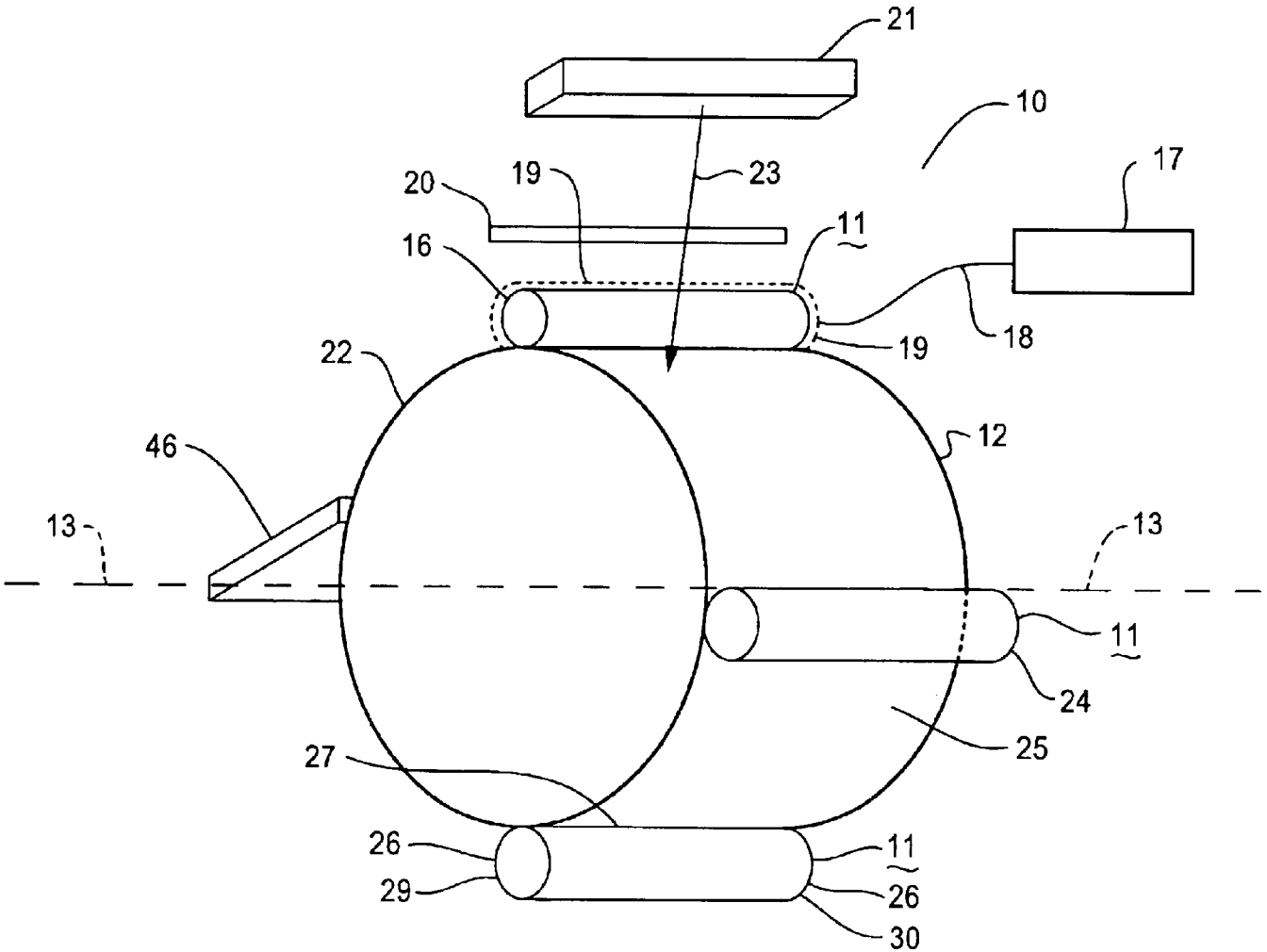
FIG. 1 is a perspective view of a modified transfer-roll system for electrophotographic printing or the like, according to one aspect of the present invention.

As shown in FIG. 1, a first of the series of rollers, desirably along an arc of rotation of the photoconductive roller, is a photostatic charging device, such as charge roller 16, mounted adjacent to and in operative contact with the photoconductive roller. Desirably, a first power source 17, e.g., a conventional high-voltage power supply, emits a first selected voltage 18 such as 900 volts dc with about 1600 volt ac swing to the charge roller to charge or otherwise activate the same with a first photostatic charge 19. The activated charge roller (e.g., which breaks down electrically along its surface near the contact line to create free charges) then applies the first photostatic charge to the photoconductive roller as it revolves about the central axis. Alternatively or concurrently, as also shown in FIG. 1, a photostatic charging device such as a corona 20 (e.g., a device with a wire held a high potential, such as 5000 volts, to create free charges) is provided for spraying the first photostatic charge onto the photoconductive roller as it rotates about the axis. After a selected portion of the photoconductive roller has been photostatically charged, a laser head 21 mounted over, but desirably not in contact with, the photoconductive roller strikes a selected charged surface 22 of the roller with a laser 23. This activates and organizes the charge on corresponding portions of the photoconductive roller into the form of the image to be printed.

A second of the series of rollers, preferably along the arc of rotation of the photoconductive roller, is a development roller 24. This roller supplies toner 25 and facilitates the transfer of toner to the photoconductive roller for subsequent printing operations. Upon contact between the toner and activated portions on the photoconductive roller, toner adheres photostatically to the roller in the form of the image.

A transfer roller 26, a third in the roller series along the photoconductor's arc of rotation, is also in operative contact with the photoconductive roller, i.e., at a selected point 27, for transferring the toner image from the photoconductive roller to first surface 2 of the printing media. According to one embodiment of the present invention, the transfer roller has at least one groove 28 in proximity to at least one of the transfer roller ends, and preferably each of roller ends 29, 30, respectively, for accommodating overhanging edges 31 of printing media (See FIGS. 13–16). More particularly, each groove allows selected distal edge portions 32 of the printing media to overhang adjacent distal ends of the transfer-roller or roller ends 29, 30. This provides a setback 33 at the paper edges axially from the transfer roller to insure that there is no contact between the paper edges and the distal ends of the transfer-roller. The grooves also separate the paper edges radially from the transfer roller, providing a depth 34 suitable for clearance of the paper from any toner that may accumulate on the photoconductive roller and, in turn, would otherwise end up on the transfer-roller.

Alternatively or concurrently, as shown in FIGS. 2–3, 8 and 11, a plurality of transfer rollers 35*a*, 35*b* and 35*c*, e.g., three or more, arranged about a rotatable carrousel 36 are utilized, the carrousel being adapted to rotate about a second central axis 37. Each roller is, in turn, rotatably mounted to the carrousel. In this manner, at least one of the rollers is positionable for operative engagement with the photoconductive roller at the selected transfer point. In addition, each roller has an effective length different than that of the other rollers such that a roller having a desired length is available and may be selected for providing or accommodating overhanging edges over a wide range of printing media widths.

According to a further embodiment of the present invention, illustrated in FIGS. 4–7, 9 and 10, a plurality of transfer rollers 38*a*, 38*b* and 38*c*, e.g., three or more, are arranged in a generally linear fashion along a translatable carriage 39. As before, each roller is rotatably mounted to the carriage such that, upon selected translation of the carriage, at least one of the rollers is positionable for operative engagement with the photoconductive roller at the selected transfer point. The carriage rollers have varying lengths such that a roller having a desired length is available and may similarly be selected to provide overhanging edges over a wide range of printing media widths.

Although the present invention has been shown and described with reference to transfer rollers with grooves, extendable ends, a carrousel or a carriage arrangement, it is understood that one or more of these features may be used, in combination, giving consideration to the purpose for which the present invention is intended. For example, rollers of the carrousel and/or carriage may have an effective length different than that of the other rollers and, concurrently, have extendable or retractable ends. It is preferred that the extendable or retractable ends be selectively incremental, thereby accommodating a wide range of printing media widths. Similarly, at least one groove may be formed in proximity to each such roller end for accommodating overhanging edges of printing media as a setback from the paper edges and for clearance from toner on the photoconductive roller. Further, it is appreciated that a carriage may include at least one carrousel and a carrousel may include at least one carriage, within the spirit and scope fo the present invention.

Figure 5:
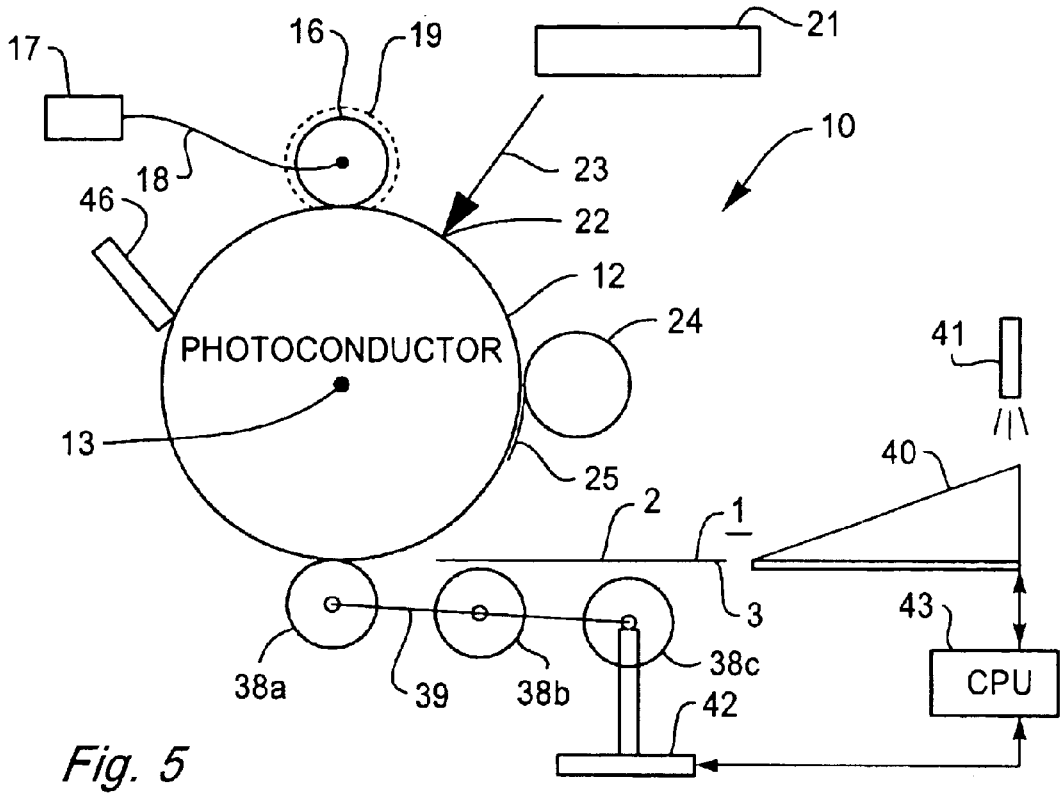
FIG. 5 is a side view of the system set forth in FIG. 4 in a first operative position, showing a feeder mechanism, detector, central processing unit and selector apparatus.
Figure 6:
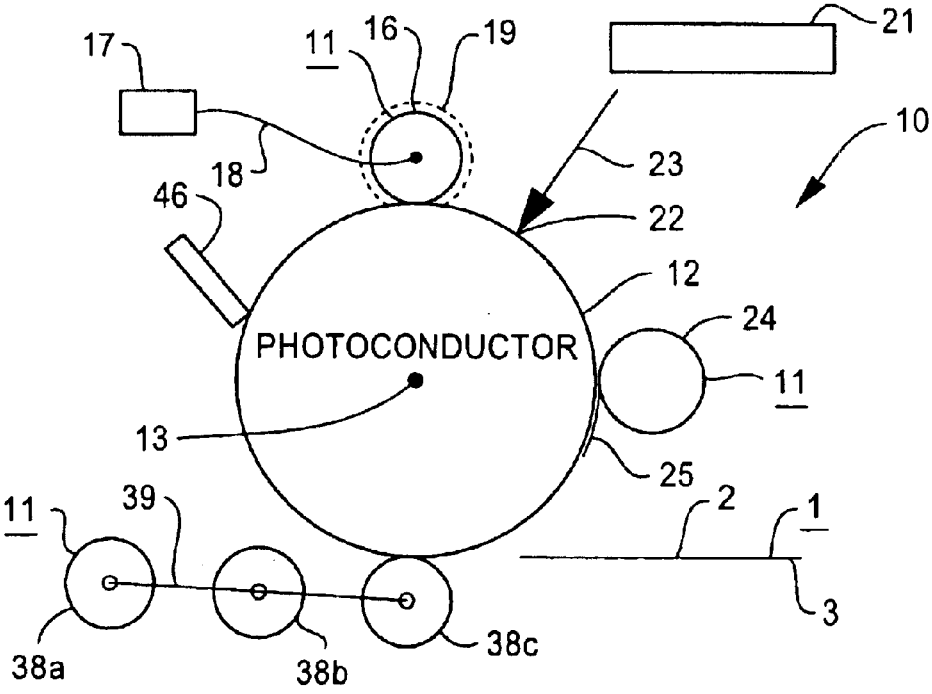
FIG. 6 is a side view of the system set forth in FIG. 4 in a second operative position.
Figure 7:
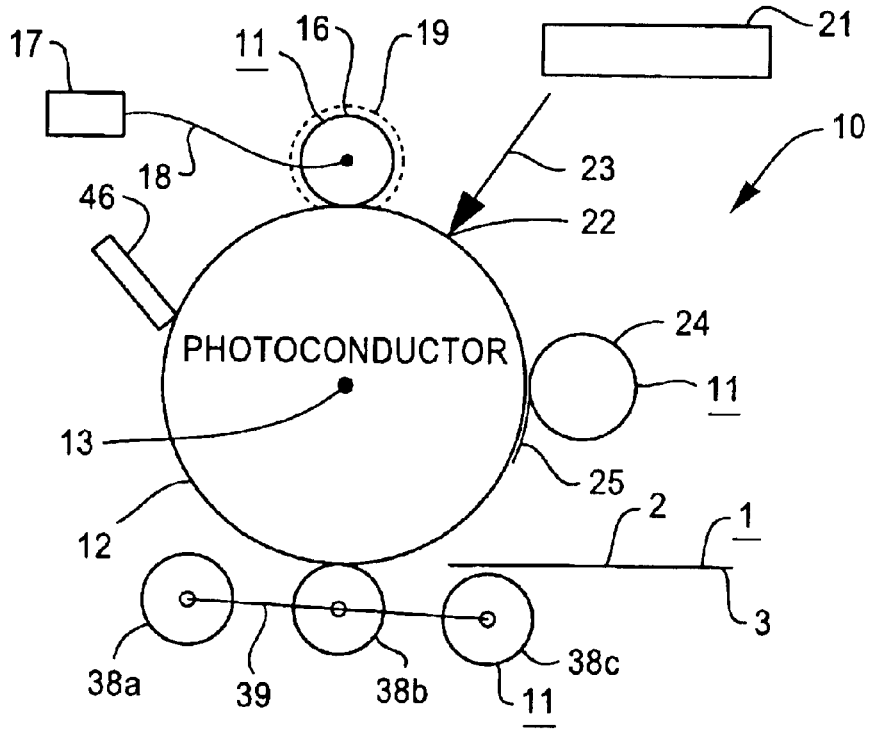
FIG. 7 is a side view of the system set forth in FIG. 4 in a third operative position.
Figure 8:
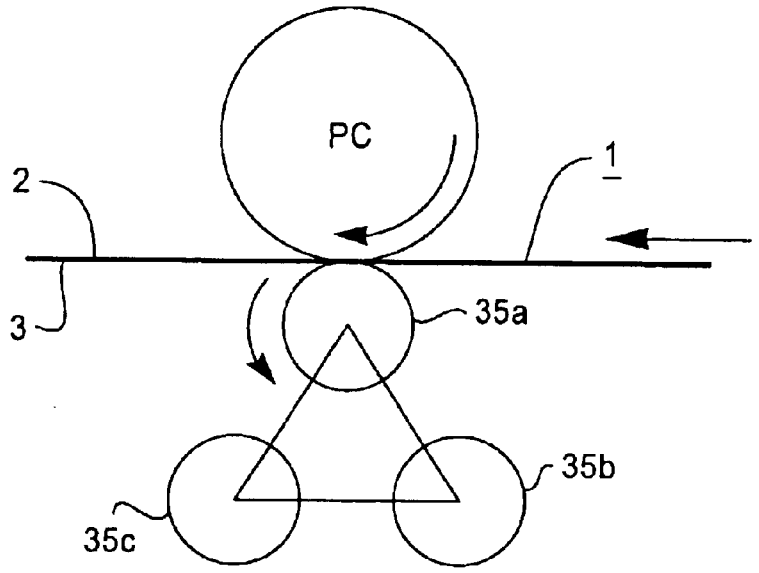
FIG. 8 is a side view of the system set forth in FIG. 2 showing a transfer-roller carrousel and a photoconductive roller operatively engaged with printing media, according to one aspect of the present invention.
Figure 9:
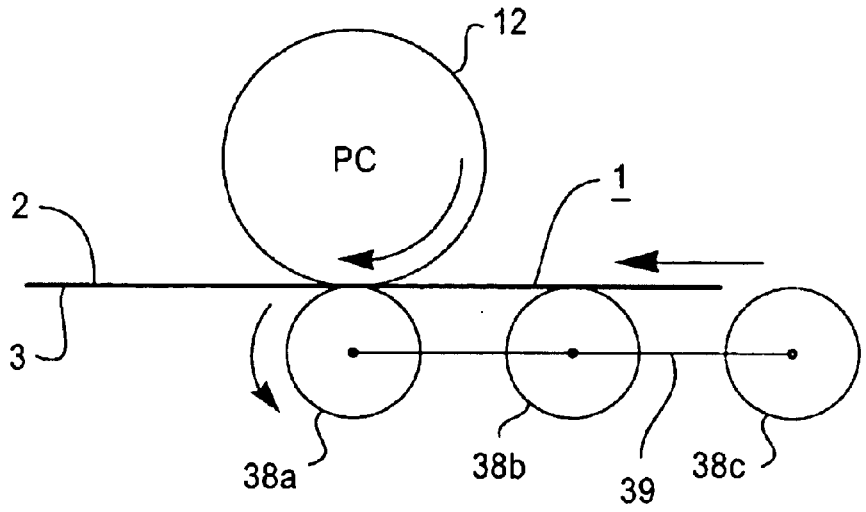
FIG. 9 is a side view of the system set forth in FIG. 4 showing a transfer-roller carriage and a photoconductive roller operatively engaged with printing media, in accordance with one aspect of the present invention.
Figure 10:
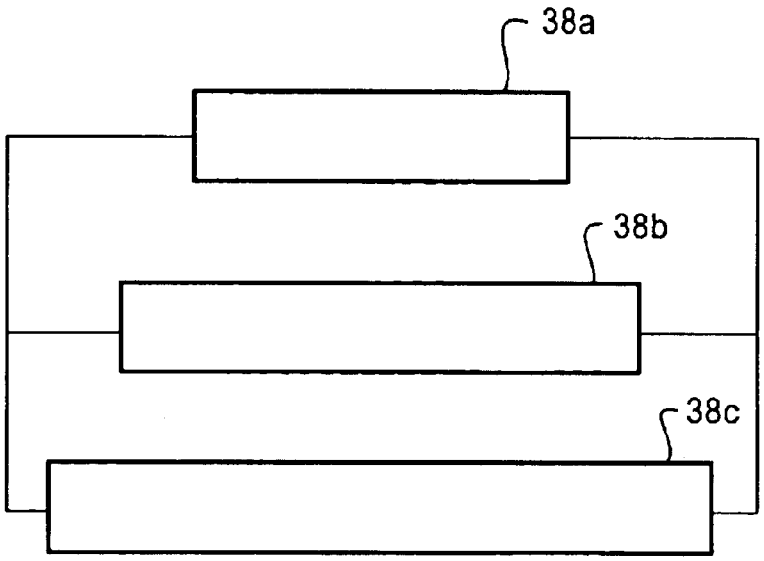
FIG. 10 is a plan view of the transfer-roller carriage set forth in FIG. 9.
Figure 11:
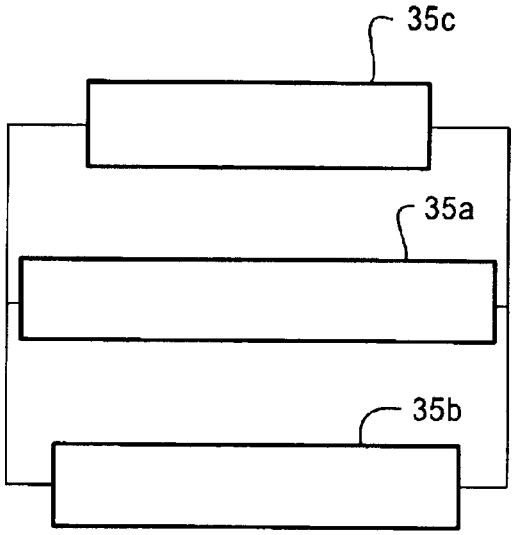
FIG. 11 is a plan view of the transfer-roller carrousel set forth in FIG. 8.

As best seen in FIG. 5, a feeder mechanism 40, e.g., a conventional document feeder, is preferably provided for transporting the printing media in tandem with the photoconductive roller and the transfer roller to the selected transfer point between the rollers. In one embodiment, it is preferred that a detector 41, e.g., conventional photoelectric eye, laser device, infrared sensor or the like, be located in proximity to the feeder mechanism to determine the width of the printing media to be operated on and/or whether a change in width of the printing media has occurred between successive printing jobs. If so, the detector activates a selector apparatus 42 which determines the appropriate length roller to be used so that the desired overhang may be achieved. The selector apparatus then effects rotation of the carrousel and, thereby, positions the appropriate roller so as to be in contact with the photoconductive roller.

Optionally, a conventional microprocessor, central processing unit or the like with software trigger 43 is utilized, alternatively or concurrently with the foregoing, for detecting printing media width. In particular, upon activation of the printer for a printing job, the printing media such as a sheet of paper is cued for printing, the user having preselected or formatted the document for a particular paper size. On this basis, the printer detects the paper size to be used and selects the appropriate printer tray containing the paper size desired. Accordingly, roller selection, as in the case of a conventional software trigger, is preferably based upon document formatting and/or the paper size selected using word processing software, e.g., Microsoft Word2002, Corel WordPerfect 9.0 or the like.

Figure 2:
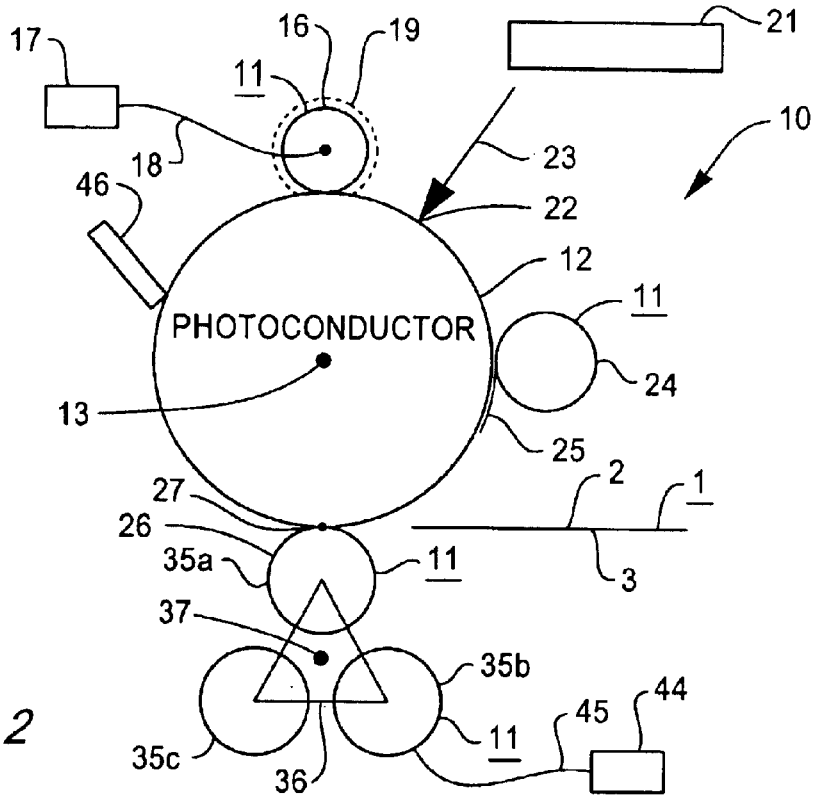
FIG. 2 is a side view of a modified transfer-roll system for electrophotographic printing or the like, in accordance with another aspect of the present invention, showing a transfer-roller carrousel in an operative position.
Figure 3:
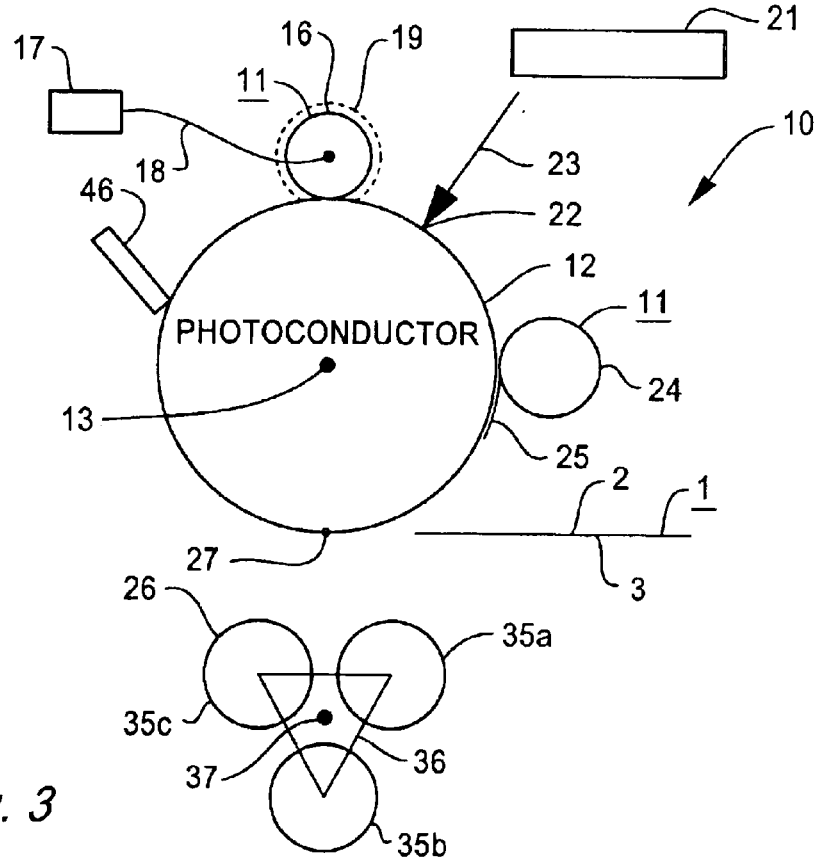
FIG. 3 is a side view of the system set forth in FIG. 2 showing a transfer-roller carrousel in a stowed position.
Figure 4:
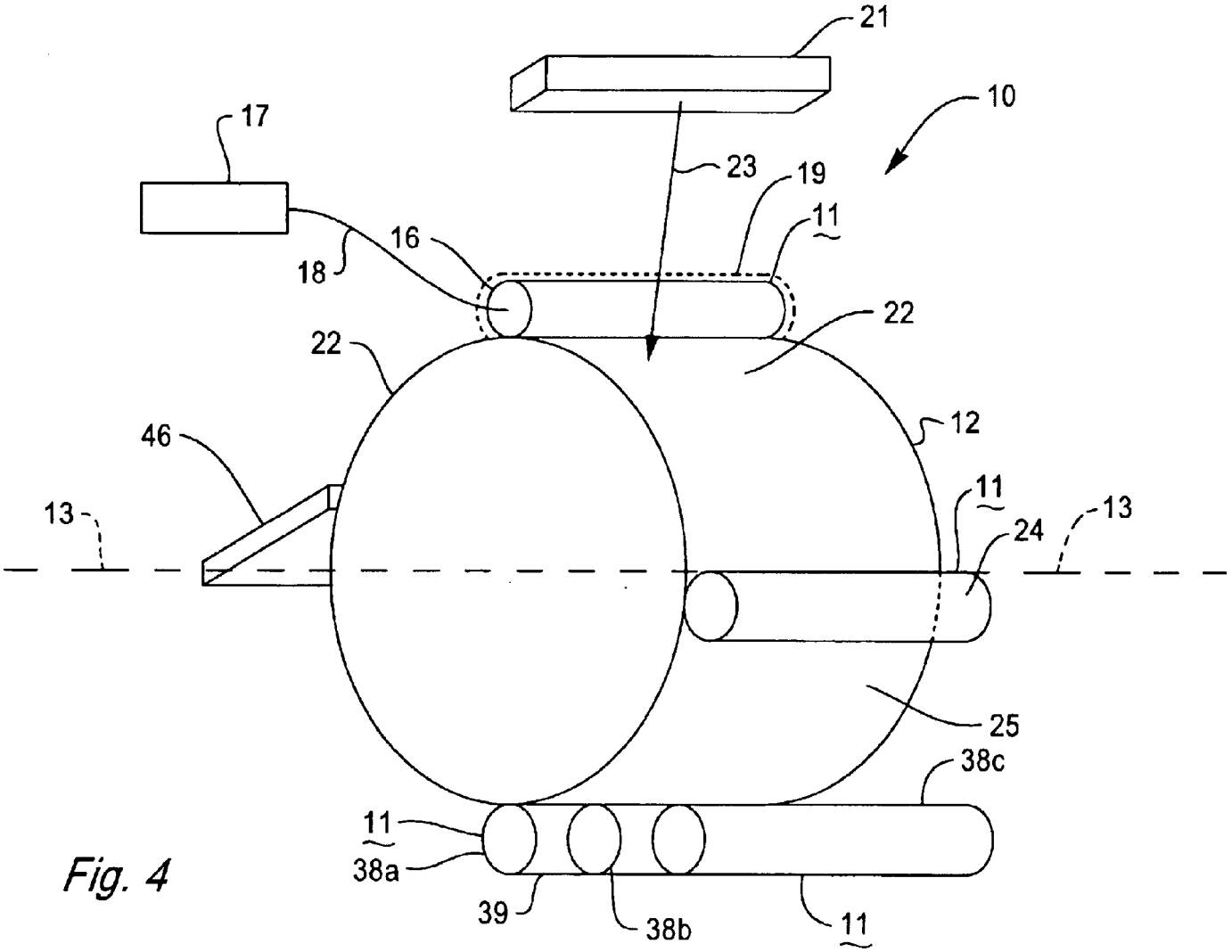
FIG. 4 is a perspective view of a modified transfer-roller system for electrophotographic printing or the like, according to a further aspect of the present invention.

As illustrated in FIG. 2, a second power source 44, e.g., a conventional electric field generator, is provided for applying a second selected voltage 45, e.g., 3000 volts, to the transfer-roller, generally upon engagement of the printing media with the contact point, in order to attract toner thereto. This effects transfer of the toner image from the photoconductive roller to the printing media first surface.

Subsequently, as the photoconductive roller rotates back around its central axis toward re-engagement with the charge roller, a cleaning blade 46, e.g., of a conventional type, scrapes against the photoconductive roller so as to clean excess toner therefrom. Alternatively, where no cleaning blade is provided, toner on the photoconductor simply returns to the development region to be reabsorbed by the development roller.

In another embodiment of the present invention, the photoconductive roller similarly collects the first photostatic charge 19 in a selected form corresponding to an image to be printed on the first surface of the printing media. Again, using the laser head, selected portions of the charge collected on the photoconductive roller are activated into the form corresponding to the image. Alternatively to or concurrently with charging of the transfer roller, the charge roller applies (and/or the corona sprays) a second photostatic charge 47 onto a second surface 4, preferably the opposite side, of the printing media 1. Charging of the second surface, it is noted, may be accomplished by other conventional techniques, giving consideration to the purpose for which the present invention is intended.

Thereafter, the development roller transfers toner to the photoconductive roller, the first photostatic charge attracting the toner and causing the toner to photostatically adhere to the photoconductive roller in the form of the image. Upon engagement of the printing media with the transfer point, i.e., where the selected transfer roller contacts the photoconductive roller, the second photostatic charge on the printing media second surface attracts the toner retained by the photoconductive roller. This attraction draws toner thereto, effecting transfer of the toner image from the photoconductive roller to the printing media first surface.

Although the present invention is shown and described in connection with electrophotographic printing, it will be appreciated that other printing applications such as digital imaging, lithographic printing, screen printing, or the like, are suitable for application of the present invention, giving consideration to the purpose for which the present invention is intended.

Figure 17:
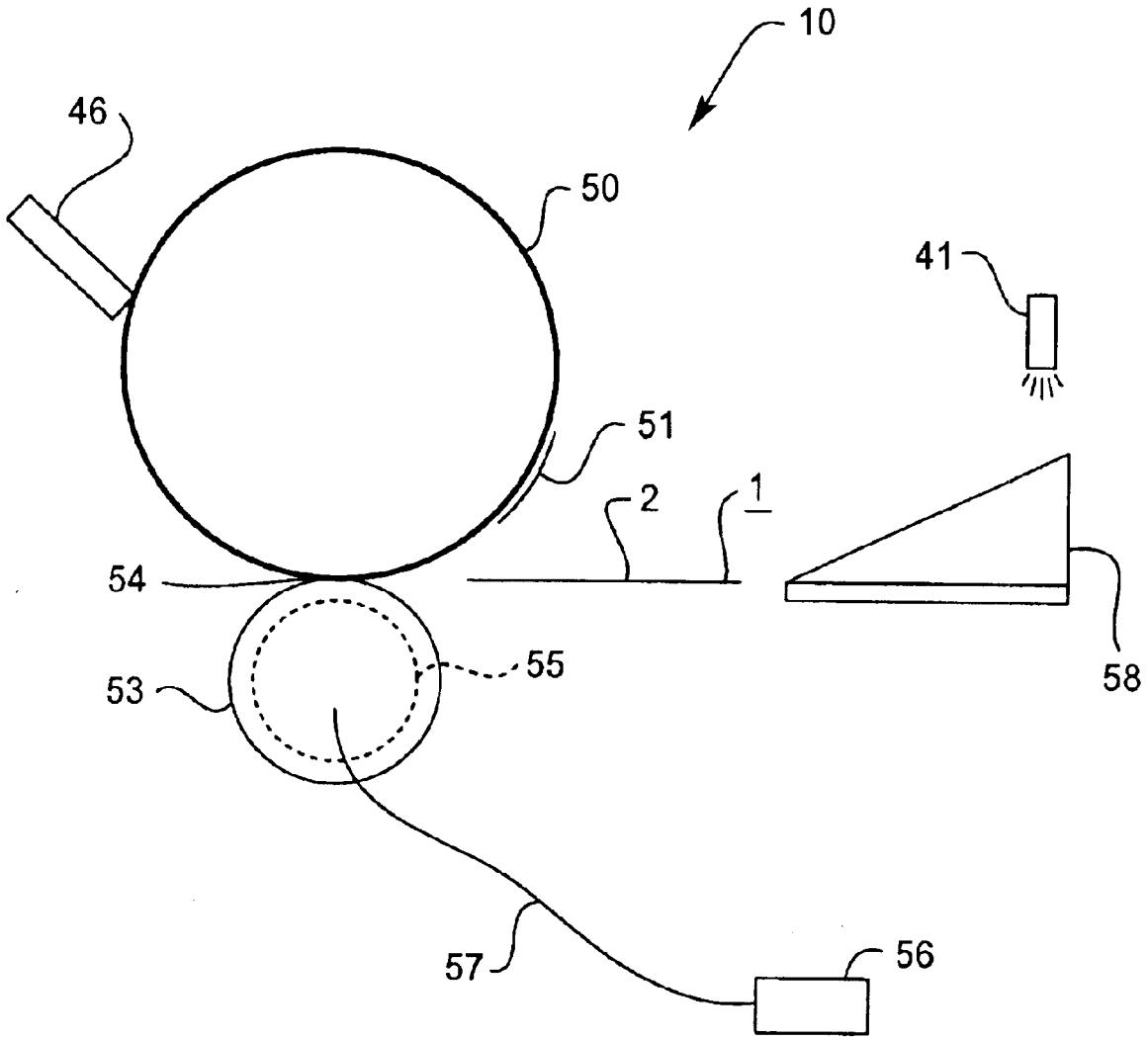
FIG. 17 is a side view of a modified transfer-roller system for applying toner on printing media, according to another aspect of the present invention.

For instance, the system may be one for applying toner or the like to printing media such as the application of clear toner to photographic paper. A system of this general description is illustrated in FIG. 17. In such a system, a roller, preferably such as drum 50, is provided for retaining toner 51 and, in turn, transferring the toner onto the first surface 2 of the printing media. A transfer roller 53 is in contact with the drum at a selected transfer point 54 for transferring a uniform layer of the toner from the drum to the first surface of the printing media. The transfer roller has at least one groove 55 in proximity to each roller end for accommodating overhanging edges of printing media as a setback from the paper edges and for clearance from toner on the drum. In addition, a power source 56, preferably a relatively high-voltage power supply such as 900 volts dc with about 1600 volt ac swing, is provided for applying a selected voltage 57 between the drum and the transfer roller and for attracting the toner thereto. This effects transfer of the uniform toner layer from the drum to the printing media first surface. Also, it is preferred that the system have a feeder 58 for transporting the printing media in tandem with the drum and transfer roller to the selected transfer point there between.

Figure 18:
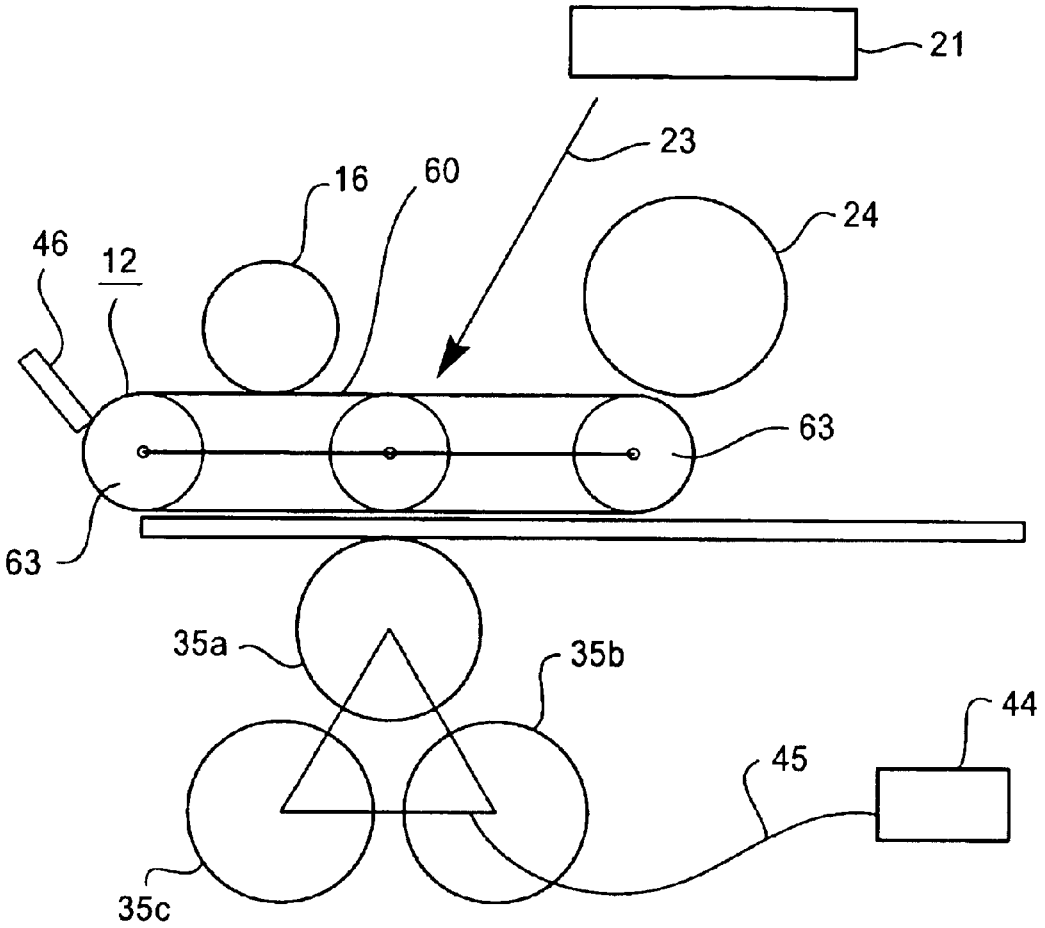
FIG. 18 is a side view of a modified transfer-roller system for electrophotographic printing, according to a further aspect of the present invention.
Figure 18A:
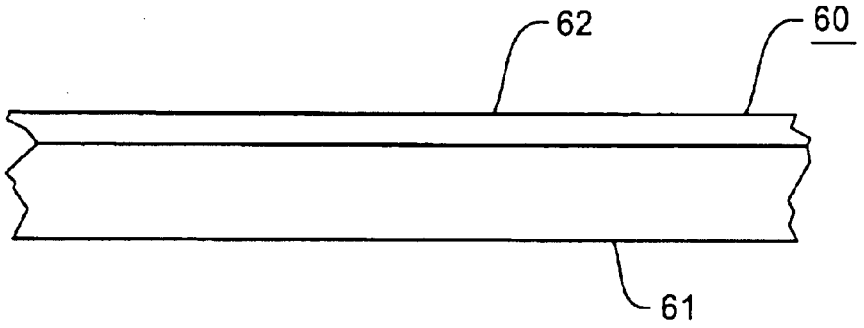
FIG. 18A is an enlarged cross sectional view of the photoconductive belt shown in FIG. 18.

According to yet a further embodiment, as illustrated in FIG. 18, the photoconductor comprises a photoconductive belt 60 used in place of, or in addition to, the above-described photoconductive roller or drum. In this connection, and as best seen in FIG. 18A, the belt preferably includes a backing 61 of a flexible polymeric material, e.g., MYLAR or the like about 75 to about 100 microns thick, with a layer of conventional photoconductive material 62, e.g., about 18 to 20 microns thick, deposited thereon. The belt is supported and operated by at least two relatively small rollers 63, and desirably by a series of three rollers arranged linearly (or, in the alternative, triangularly) and at a selected distance from one another so as to retain the belt in a relatively taut condition.

Turning now to another aspect of the present invention, there is provided a method for printing an image electrophotographically on printing media. First, the photoconductor, such as photoconductive roller 12 or belt 60, for collecting the photostatic charge is moved continuously in a first direction. In the case of a roller or belt, it is preferred that movement proceed in a clockwise fashion, or alternatively counterclockwise, about the central axis thereof. The photostatic charging device, e.g., charge roller, rotates adjacent to and in tandem with the photoconductive roller, more or less concurrently therewith, but in a second direction generally opposite to that of the first. It is considered inherent or desirable that a step be included for charging or otherwise activating the charge roller with the photostatic charge, preferably using a first selected voltage from a first power source. This step may be performed before, during or after the charge roller commences its rotation relative to the photoconductive roller. Desirably, during this operation, surface portions of the charge roller are in contact with, or otherwise in operative engagement with, corresponding surface portions of the photoconductive roller.

Alternatively or concurrently, a corona is used to spray the photostatic charge onto the photoconductive roller. The corona may operate independently or concurrently with the charge roller and is similarly activated by the first selected voltage from the first power source.

Next, laser head 21, in proximity to the photoconductive roller, directs laser 23 upon selected portions of the charge applied to the photoconductive roller, thereby activating the charge in a form corresponding to the image to be printed on the printing media.

Continuing in a generally clockwise direction, the development roller is then encountered. The development roller moves, preferably by rotation, adjacent to and in tandem with the photoconductive roller, but in a third direction generally opposite to that of the first, such that surface portions of the development roller are in contact with corresponding portions on the photoconductive roller. Upon operative engagement of the development roller surface portions with corresponding portions of the photoconductive roller, toner is transferred from the development roller to the photoconductive roller. The toner photostatically adheres to the photoconductive roller in the form corresponding to the image to be printed.

Thereafter, it is preferred that detector 41 determine the width of the printing media to be operated on, or alternatively, whether a change in width of the printing media has occurred between successive printing jobs. After determining the width or width change, the detector activates the selector apparatus 42 which selects an appropriate width transfer roller to be used in order to achieve the desired overhang, and positions the selected roller into contact with the photoconductive roller. The point of contact desirably defines a selected point for transferring toner from the photoconductive roller to a first surface of the printing media. Optionally, the desired overhang is accomplished by providing at least one groove in proximity to at least one of the transfer roller ends, and preferably each of the ends, for accommodating overhanging edges of printing media as a setback from the paper edges and for clearance from toner on the photoconductive roller.

In another embodiment, the selector apparatus selects a transfer roller having extendable ends and positions the roller into contact with the photoconductive roller, the point of contact defining the selected point for transferring toner from the photoconductive roller to the first surface of the printing media. The apparatus then causes at least one end of the transfer roller, and preferably both ends, to be extended a selected distance such that at least one groove is formed in proximity to each roller end suitable for accommodating overhanging edges of printing media. Specifically, each groove serves as a setback from the paper edges and provides clearance from toner on the photoconductive roller.

Alternatively or concurrently, the selector apparatus effects rotation of a carrousel having a plurality of transfer rollers arranged thereabout and each roller being rotatably mounted thereto so as to position at least one of the rollers in contact with the photoconductive roller. As before, the point of contact defines a selected point for transferring the toner image from the photoconductive roller to the first surface of the printing media. Each roller has an effective length different than that of the other rollers so as to enable overhanging edges of printing media having a selected width. Such overhanging edges desirably provide a setback from the paper edges and clearance from toner on the photoconductive roller.

According to a further alternative embodiment, the selector apparatus effects translation of a translatable carriage with a plurality of transfer rollers rotatably mounted thereto so as to position at least one of the rollers in contact with the photoconductive roller. Again, the point of contact defines a selected point for transferring the toner image from the photoconductive roller to the first surface of the printing media. As with the carrousel, each roller also has an effective length different than that of the other rollers so as to enable overhanging edges of printing media having a selected width, such overhanging edges providing a setback from the paper edges and clearance from toner on the photoconductive roller.

In still another embodiment, one or more rollers of the carrousel and/or carriage have an effective length different than that of the other rollers and, concurrently, have extendable or retractable ends. In this fashion, at least one groove is formed in proximity to each such roller end for accommodating overhanging edges of printing media as a setback from the paper edges and for clearance from toner on the photoconductive roller. With retractable ends, it is preferred that such retraction be selectively incremental, thereby providing, as part of a carrousel and/or carriage, numerous options and variations for accommodating paper widths.

The printing media is then transported, preferably using a feeder, in tandem with and to the point between the photoconductive roller and the transfer roller. A second selected voltage from a second power source is applied to the transfer roller so as to attract toner on the photoconductive roller toward the transfer roller. This effects transfer of the toner image from the photoconductive roller to the printing media first surface.

While the present invention has been shown and described with reference to first and second power sources and corresponding first and second voltages, those skilled in the art will appreciate that similar or the same power sources and/or voltages could be utilized to generate a photostatic charge or otherwise draw toner in the desired direction, within the spirit and scope of the present invention.

According to an alternative embodiment, a method for printing an image electrophotographically is provided by which the photoconductor, e.g., photoconductive roller, for collecting the first photostatic charge is initially moved or rotated continuously in a first direction, e.g., clockwise, about its central axis. The charge roller rotates adjacent to and in tandem with the photoconductive roller, more or less concurrently therewith, but in a second direction generally opposite to that of the first. Again, it is inherent and/or preferred that the charge roller be activated with the first photostatic charge using the first power source for emitting the first selected voltage. Preferably, surface portions of the charge roller are in contact with or otherwise in operative engagement with corresponding surface portions of the photoconductive roller. Using the activated charge roller, the first photostatic charge is then applied to the photoconductive roller. Alternatively or concurrently, the corona is used to apply the first photostatic charge to the photoconductive roller.

Next, desirably the laser head, in proximity to the photoconductive roller, directs laser 23 upon selected portions of the first charge applied to the photoconductive roller, thereby activating the charge in a form of the image to be printed on the printing media.

As before, the development roller is then encountered. The development roller rotates adjacent to and in tandem with the photoconductive roller, but in a third direction generally opposite to that of the first, such that surface portions of the development roller are in contact with corresponding portions on the photoconductive roller. Upon operative engagement of the development roller surface portions with corresponding portions of the photoconductive roller, toner is transferred from the development roller to the photoconductive roller. Notably, the first photostatic charge selected must be suitable for the toner to adhere photostatically to the photoconductive roller, upon said operative engagement, in the form corresponding to the image to be printed.

Thereafter, the detector determines the width of the printing media to be operated on, or alternatively, whether a change in width of the printing media, between successive printing jobs, has occurred. After determining the respective width or width change, the detector activates the selector apparatus which, in turn, selects an appropriate width transfer roller to be used in order to achieve the desired overhang, and positions the selected roller into contact with the photoconductive roller. The point of contact defines a selected point for transferring toner from the photoconductive roller to the first surface of the printing media.

More particularly, according to one embodiment, the desired overhang is accomplished by providing at least one groove in proximity to at least one of the transfer roller ends, and preferably each of the ends, for accommodating overhanging edges of printing media as a setback from the paper edges and for clearance from toner on the photoconductive roller.

In another embodiment, the selector apparatus selects a transfer roller having extendable ends and positions the roller into contact with the photoconductive roller, the point of contact defining the selected point for transferring toner from the photoconductive roller to the first surface of the printing media. The apparatus then causes at least one end of the transfer roller, and preferably both ends, to be extended a selected distance such that at least one groove is formed in proximity to the corresponding roller end for accommodating overhanging edges of printing media. This serves as a setback from the paper edges and provides clearance from toner on the photoconductive roller.

Alternatively or concurrently, the selector apparatus effects rotation of a carrousel having a plurality of transfer rollers arranged thereabout and each roller being rotatably mounted thereto so as to position at least one of the rollers in contact with the photoconductive roller. Again, the point of contact defines a selected point for transferring the toner image from the photoconductive roller to the first surface of the printing media. Each roller has an effective length different than that of the other rollers so as to enable overhanging edges of printing media having a selected width. It is desired that these overhanging edges provide a setback from the paper edges and clearance from toner on the photoconductive roller.

Further alternatively, the selector apparatus effects translation of a translatable carriage with a plurality of transfer rollers rotatably mounted thereto so as to position at least one of the rollers in contact with the photoconductive roller. The point of contact defines a selected point for transferring the toner image from the photoconductive roller to the first surface of the printing media. As also with the carrousel, each roller has an effective length different than that of the other rollers so as to enable overhanging edges of printing media having a selected width, such overhanging edges providing a setback from the paper edges and clearance from toner on the photoconductive roller.

According to still another alternative embodiment, one or more rollers of the carrousel and/or carriage have an effective length different than that of the other rollers and, concurrently, have extendable or retractable ends. In this fashion, at least one groove is formed in proximity to each such roller end for accommodating overhanging edges of printing media as a setback from the paper edges and for clearance from toner on the photoconductive roller. With retractable ends, it is preferred that such retraction be selectively incremental, thereby providing, as part of a carrousel and/or carriage, numerous options and variations for accommodating paper widths.

Thereafter, the printing media is transported, preferably using the feeder, in tandem with and to the point between the photoconductive roller and the transfer roller. At this point, toner is transferred to the printing media first surface. In particular, the printing media desirably has a second surface with a second photostatic charge that attracts toner retained by the photoconductive roller to the printing media first surface and adheres the toner thereto. This effects transfer of the toner image from the photoconductive roller to the printing media first surface.

While the present invention has been shown and described in connection with printing on paper, it will be appreciated by those skilled in the art that other materials may be utilized. For example, use of materials such as photographic paper, cardboard (coated or un-coated), laminated paper, cloth, plastic transparencies and/or other polymeric sheeting are considered to be within the spirit and scope of the present invention.

Referring now to operations applicable to both electrophotographic and non-electrophotographic applications, a specific, illustrative method is provided for printing toner or the like on printing media. Initially, the drum for retaining toner is rotated in a first direction. The transfer roller is then rotated in a second direction generally opposite to that of the first. Desirably, the transfer roller is in contact with the drum at a selected transfer point for transferring a uniform layer of the toner from the drum to a first surface of the printing media. At least one end of the transfer roller is suitably sized and configured, e.g., with a selected roller length and/or groove in proximity to a roller end, for accommodating overhanging edges of printing media as a setback from the paper edges and for clearance from toner on the drum. Using a selected power source, a selected voltage is desirably applied between the drum and the transfer roller for attracting the toner thereto so as to effect transfer of the uniform toner layer from the drum to the printing media first surface.

Another option, according to the present invention, is a method for printing toner or the like on printing media, wherein the development roller for retaining toner in a form of an image desired to be printed is first rotated in a first direction. The transfer roller is then rotated in a second direction generally opposite to that of the first. The transfer roller, again, is in contact with the development roller at the selected transfer point for transferring a uniform layer of the toner from the development roller to a first surface of the printing media. The toner adheres to the first surface at the selected transfer point, at least one end of the transfer roller being sized and configured for accommodating overhanging edges of printing media as a setback from the paper edges and for clearance from toner on the drum.

Generally speaking, the system components, as set forth herein, including but not limited to the charge roller, laser head, development roller, photoconductive roller, feeder, and scraper as well as their materials of construction, are considered conventional, and further description is believed unnecessary for purposes of illustration of the present invention. In this connection, each of the rollers and other components of the present invention may notably be constructed of the same material, e.g., plastics such as polyurethane, polyvinyl chloride or like polymeric materials; aluminum, stainless steel, titanium, copper or the like; may be constructed of different materials, or in any combination thereof, within the spirit and scope of the present invention.

Overall, the present invention advantageously provides improved quality images by electrophotographic printing or the like, without regard to the material used or the geometry of the printing media. Not only is toner coverage and the corresponding image produced both even and uniform, but also the resulting improvements extend to the physical edges of the media, simply, practically, reliably and at relatively low cost.

The present invention prevents toner and corresponding portions of the desired image from coming into contact with the transfer-roller. This virtually eliminates the need for specialized applications software, trial and error, manual adjustment of printing apparatus, and/or other active, albeit less reliable, means for keeping the printed image on the paper and away from the paper edges. The invention prevents toner from being transferred onto the back side of the paper, which hinders fusion of the toner thereto. It also conserves toner, extends the useful life of the transfer-roller and eliminates the need for turning the transfer voltage off-on-off repeatedly between sheets of paper.

In this manner, the user may repeatedly go from printing on 8½×11 inch paper to envelopes, or other media considerably narrower than the transfer-roller, and back again without being concerned about toner accumulating on the rollers, despoiling the paper or otherwise affecting the quality of image reproduction. Minimal In addition, the present invention is beneficial for use in printing on photographic paper and other applications where it is highly desirable for images to be printed to the edges of the paper. To insure coverage of the entire surface, the photoconductor itself and, hence, the photoconductor toner layer should be wider generally, e.g., by several millimeters, than the photo paper. By the present invention, a thick, clear, uniform toner layer may now be placed all the way to the edge of the photo paper, laid upon an ink-jet printed image and electrostatically fused to the paper for added protection against moisture.

Accordingly, the present invention provides an improved transfer-roller system and method for enhanced printing, digital imaging, reproduction or the like. By preventing contact between toner on the photoconductive roller and toner transfer-roller during printing operations, the entire image to be printed and corresponding toner is transferred effectively and efficiently to the printing media. This complete image reproduction is achieved consistently and reliably, regardless of the geometry of the printing media or speed of operation.

Moreover, a practical, durable and adjustable transfer-roller is provided generally narrower than the printing media such that a selected setback from the printing media edge, and a selected clearance between the media edges and the roller, are provided. In this manner, no toner may contact, jump or otherwise transfer to the transfer-roller, while a uniform contact pressure necessary for quality printing is maintained between the printing media and photoconductive roller. This prevents the deposit of toner stripes on the transfer-roller, thereby increasing the useful life of conventional rollers.

The present invention is effective and easy to use, has energy requirements that are nominal, is operated with minimal skill and vigilance of the user and with nominal maintenance and service. Furthermore, as the present invention may be effected by a relatively minor modification of conventional printing apparatus, it is not only inexpensive to manufacture and implement, but also environmentally friendly to construct and operate.

Various modifications and alterations to the present invention may be appreciated based on a review of this disclosure. These changes and additions are intended to be within the scope and spirit of this invention as defined by the following claims.

What is claimed is:

1. A system for electrophotographic printing, which comprises:

a photoconductive roller for collecting a photostatic charge in a selected form corresponding to an image to be printed, and for retaining toner in the form of the image on a first surface of printing media;

a photostatic charging device for applying the photostatic charge to the photoconductive roller;

a laser for activating selected portions of the charge applied to the photoconductive roller, such portions being in the form of the image;

a development roller for transferring toner to the photoconductive roller, the toner photostatically adhering to the photoconductive roller in the form of the image;

a transfer roller in contact with the photoconductive roller at a selected transfer point for transferring the toner image from the photoconductive roller to the first surface of the printing media, the transfer roller having at least one groove in proximity to each roller end for accommodating overhanging edges of printing media as a setback from the paper edges and for clearance from toner on the photoconductive roller;

a power source for applying a selected voltage to the transfer roller and attracting the toner thereto so as to effect transfer of the toner image from the photoconductive roller to the printing media first surface; and a feeder for transporting the printing media in tandem with the photoconductive and transfer rollers to the selected transfer point between the rollers.

2. The system set forth in claim 1 wherein the photostatic charging device is a charge roller.

3. The system set forth in claim 1 wherein the photostatic charging device is a corona for spraying the photostatic charge onto the photoconductive roller.

4. A system for electrophotographic printing, which comprises:

a photoconductive roller for collecting a first photostatic charge in a selected form corresponding to an image to be printed, and for retaining toner in the form of the image for printing on a first surface of printing media;

a photostatic charging device for applying the first photostatic charge to the photoconductive roller;

a laser for activating selected portions of the charge collected on the photoconductive roller into the form corresponding to the image;

a development roller for transferring toner to the photoconductive roller, the first photostatic charge attracting the toner and causing the toner to photostatically adhere to the photoconductive roller in the form of the image;

a transfer roller in contact with the photoconductive roller at a selected transfer point, a second surface of the printing media having a second photostatic charge for attracting the toner retained by the photoconductive roller so as to effect transfer of the toner image from the photoconductive roller to the printing media first surface, the transfer roller having at least one groove in proximity to each roller end for accommodating overhanging edges of printing media as a setback from edges of the printing media and for clearance from toner on the photoconductive roller; and a feeder for transporting the printing media in tandem with the photoconductive and transfer rollers to the selected transfer point between the rollers.

5. A system for electrophotographic printing, which comprises:

a photoconductive roller for collecting a photostatic charge in a selected form corresponding to an image to be printed, and for retaining toner in the form of the image on a first surface of printing media;

a photostatic charging device for applying the photostatic charge to the photoconductive roller;

a laser for activating selected portions of the charge applied to the photoconductive roller, such portions being in the form of the image;

a development roller for transferring toner to the photoconductive roller, the toner photostatically adhering to the photoconductive roller in the form of the image;

a transfer roller in contact with the photoconductive roller at a selected transfer point for transferring the toner image from the photoconductive roller to the first surface of the printing media, the transfer roller having extendable roller ends such that, upon their extension a selected distance, at least one groove is formed in proximity to each roller end for accommodating overhanging edges of printing media as a setback from the paper edges and for clearance from toner on the photoconductive roller;

a power source for applying a selected voltage to the transfer roller and attracting the toner thereto so as to effect transfer of the toner image from the photoconductive roller to the printing media first surface; and a feeder for transporting the printing media in tandem with the photoconductive and transfer rollers to the selected transfer point between the rollers.

6. A system for electrophotographic printing, which comprises:

a photoconductive roller for collecting a first photostatic charge in a selected form corresponding to an image to be printed, and for retaining toner in the form of the image for printing on a first surface of printing media;

a photostatic charging device for applying the first photostatic charge to the photoconductive roller;

a laser for activating selected portions of the charge collected on the photoconductive roller into the form corresponding to the image;

a development roller for transferring toner to the photoconductive roller, the first photostatic charge attracting the toner and causing the toner to photostatically adhere to the photoconductive roller in the form of the image;

a transfer roller in contact with the photoconductive roller at a selected transfer point, a second photostatic charge on the printing media second surface attracting the toner retained by the photoconductive roller so as to effect transfer of the toner image from the photoconductive roller to the printing media first surface, the transfer roller having extendable roller ends such that, upon their extension a selected distance, at least one groove is formed in proximity to each roller end for accommodating overhanging edges of printing media as a setback from edges of the printing media and for clearance from toner on the photoconductive roller; and a feeder for transporting the printing media in tandem with the photoconductive and transfer rollers to the selected transfer point between the rollers.

7. A system for printing toner or the like on printing media, which comprises:

a drum for retaining toner;

a transfer roller in contact with the drum at a selected transfer point for transferring a uniform layer of the toner from the drum to a first surface of the printing media, at least one end of the transfer roller being sized and configured for accommodating overhanging edges of printing media as a setback from the paper edges and for clearance from toner on the drum; and a power source for applying a selected voltage between the drum and the transfer roller for attracting the toner thereto so as to effect transfer of the uniform toner layer from the drum to the printing media first surface.

8. The system set forth in claim 7 further comprising a development roller for transferring toner to the drum, the toner adhering to the drum in the form of an image desired to be printed.

9. A system for printing toner or the like on printing media, which comprises a development roller for retaining toner in a form of an image desired to be printed; and a transfer roller in contact with the development roller at a selected transfer point for transferring a uniform layer of the toner from the development roller to a first surface of the printing media, the toner adhering to the first surface at the selected transfer point, at least one end of the transfer roller being sized and configured for accommodating overhanging edges of printing media as a setback from the paper edges and for clearance from toner on the drum.

10. A method for printing an image electrophotographically on printing media, which comprises the steps of:

i. moving in a first direction a photoconductor for collecting a photostatic charge;

ii. using a selected voltage from a power source, charging the photoconductor with the photostatic charge;

iii. activating selected portions of the charge on the photoconductor corresponding to an image to be printed on a first surface of the printing media;

iv. rotating a development roller adjacent to and in tandem with the photoconductor but in a third direction generally opposite to that of the first;

v. transferring toner from the development roller to the photoconductor, the toner photostatically adhering to the photoconductor in a form corresponding to the image to be printed;

vi. placing a transfer roller in contact with the photoconductor, the point of contact defining a selected point for transferring toner from the photoconductor to the first surface of the printing media, the transfer roller having at least one groove in proximity to each roller end for accommodating overhanging edges of printing media as a setback from the paper edges and for clearance from toner on the photoconductor;

vii. transporting the printing media in tandem with and to a point between the photoconductor and the transfer roller; and viii. attracting toner on the photoconductor toward the transfer roller so as to effect transfer of the toner image from the photoconductor to the printing media first surface.

11. The method set forth in claim 10 wherein the step of charging of the photoconductor is performed using a charge roller.

12. The system set forth in claim 10 wherein the step of charging of the photoconductor is performed using a corona.

13. A method for printing an image electrophotographically on printing media, which comprises the steps of:

i. moving in a first direction a photoconductor for collecting a photostatic charge;

ii. using a selected voltage from a power source, charging the photoconductor with the photostatic charge;

iii. activating selected portions of the charge on the photoconductor corresponding to an image to be printed on a first surface of the printing media;

iv. rotating a development roller adjacent to and in tandem with the photoconductor but in a third direction generally opposite to that of the first;

v. transferring toner from the development roller to the photoconductor, the toner photostatically adhering to the photoconductor in a form corresponding to the image to be printed;

vi. placing a transfer roller having extendable ends in contact with the photoconductor, the point of contact defining a selected point for transferring toner from the photoconductor to the first surface of the printing media;

vii. extending the ends of the transfer roller a selected distance such that at least one groove is formed in proximity to each roller end for accommodating overhanging edges of printing media as a setback from the paper edges and for clearance from toner on the photoconductor;

viii. transporting the printing media in tandem with and to a point between the photoconductor and the transfer roller; and ix. attracting toner on the photoconductor toward the transfer roller so as to effect transfer of the toner image from the photoconductor to the printing media first surface.

14. A method for printing toner or the like on printing media, which comprises the steps of:

i. rotating in a first direction a drum for retaining toner;

ii. rotating a transfer roller in a second direction generally opposite to that of the first, the transfer roller being in contact with the drum at a selected transfer point for transferring a uniform layer of the toner from the drum to a first surface of the printing media, at least one end of the transfer roller being sized and configured for accommodating overhanging edges of printing media as a setback from the paper edges and for clearance from toner on the drum; and iii. using a selected power source, applying a selected voltage between the drum and the transfer roller for attracting the toner thereto so as to effect transfer of the uniform toner layer from the drum to the printing media first surface.

15. A method for printing toner or the like on printing media, which comprises the steps of:

i. rotating in a first direction a development roller for retaining toner in a form of an image desired to be printed;

ii. rotating a transfer roller in a second direction generally opposite to that of the first, the transfer roller being in contact with the development roller at a selected transfer point for transferring a uniform layer of the toner from the development roller to a first surface of the printing media, the toner adhering to the first surface at the selected transfer point, at least one end of the transfer roller being sized and configured for accommodating overhanging edges of printing media as a setback from the paper edges and for clearance from toner on the drum.

16. An apparatus for use in a system including a photoconductor for collecting a photostatic charge in a selected form corresponding to an image to be printed, and for retaining toner in the form of the image on a first surface of printing media, the apparatus including a transfer roller in contact with the photoconductor at a selected transfer point for transferring the toner image from the photoconductor to the first surface of the printing media, the transfer roller having at least one groove in proximity to each roller end for accommodating overhanging edges of printing media as a setback from the paper edges and for clearance from toner on the photoconductor.

17. An apparatus for use in a system including a photoconductor for collecting a photostatic charge in a selected form corresponding to an image to be printed, and for retaining toner in the form of the image on a first surface of printing media, the apparatus including a transfer roller in contact with the photoconductor at a selected transfer point for transferring the toner image from the photoconductor to the first surface of the printing media, the transfer roller having extendable roller ends such that, upon their extension a selected distance, at least one groove is formed in proximity to each roller end for accommodating overhanging edges of printing media as a setback from the paper edges and for clearance from toner on the photoconductor.

18. A system for electrophotographic printing, which comprises:

a photoconductive belt for collecting a photostatic charge in a selected form corresponding to an image to be printed, and for retaining toner in the form of the image on a first surface of printing media;

a photostatic charging device for applying the photostatic charge to the photoconductive belt;

a laser for activating selected portions of the charge applied to the photoconductive belt, such portions being in the form of the image;

a development roller for transferring toner to the photoconductive belt, the toner photostatically adhering to the photoconductive belt in the form of the image; a transfer roller in contact with the photoconductive belt at a selected transfer point for transferring the toner image from the photoconductive belt to the first surface of the printing media, at least one end of the transfer roller being sized and configured for accommodating overhanging edges of printing media as a setback from the paper edges and for clearance from toner on the photoconductive belt;

a power source for applying a selected voltage to the roller and attracting the toner thereto so as to effect transfer of the toner image from the photoconductive roller to the printing media first surface; and a feeder for transporting the printing media in tandem with the photoconductive and transfer rollers to the selected transfer point between the rollers.

19. A system for electrophotographic printing, which comprises:

a photoconductive belt for collecting a photostatic charge in a selected form corresponding to an image to be printed, and for retaining toner in the form of the image on a first surface of printing media;

a photostatic charging device for applying the photostatic charge to the photoconductive belt;

a laser for activating selected portions of the charge applied to the photoconductive belt, such portions being in the form of the image;

a development roller for transferring toner to the photoconductive belt, the toner photostatically adhering to the photoconductive belt in the form of the image;

a transfer roller in contact with the photoconductive belt at a selected transfer point, a second surface of the printing media having a second photostatic charge for attracting the toner retained by the photoconductive belt so as to effect transfer of the toner image from the photoconductive belt to the printing media first surface, at least one end of the transfer roller being sized and configured for accommodating overhanging edges of printing media as a setback from the paper edges and for clearance from toner on the photoconductive belt; and a feeder for transporting the printing media in tandem with the photoconductive and transfer rollers to the selected transfer point between the rollers.

* * * * *